US006157095A

United States Patent [19]

Namuduri

[11] Patent Number: 6,157,095

[45] Date of Patent: Dec. 5, 2000

[54] CONTROL CIRCUIT FOR INDUCTIVE LOADS

[75] Inventor: Chandra Sekhar Namuduri, Sterling Heights, Mich.

[73] Assignee: Delphi Technologies, Inc., Troy, Mich.

[21] Appl. No.: 09/206,128

[22] Filed: Dec. 4, 1998

[51] Int. Cl.[7] ..... H01H 47/00

[52] U.S. Cl. ..... 307/125; 361/154; 361/159

[58] Field of Search ..... 307/125; 327/108, 327/110; 361/154, 159

[56] References Cited

U.S. PATENT DOCUMENTS 4,949,215 8/1990 Studtmann et al. ..... 361/154

*Primary Examiner*—Josie Ballato
*Assistant Examiner*—Robert L. Deberadinis
*Attorney, Agent, or Firm*—Robert M. Sigler

[57] ABSTRACT

A control circuit for controlling the current through an inductive load powered by a unipolar power source. The current through the inductive load is controlled by three electronic switches and a subcircuit. The switches provide three different voltage levels across the inductive load. The closing of the first switch supplies positive voltage across the load, thereby increasing the load current. Opening of the first switch and closing of the third switch disconnects the power source from the load and short circuits the inductive load resulting in zero voltage across the load. Opening of the third and first switches directs the inductive current through the subcircuit, developing a negative voltage across the load and thereby rapidly decreasing the inductive current. By controlling the load voltage between a positive and zero voltage and between a negative and zero voltage, the load current is changed quickly and efficiently.

3 Claims, 5 Drawing Sheets

CONTROL CIRCUIT FOR INDUCTIVE LOADS

TECHNICAL FIELD

This invention relates to a control circuit for controlling the current flow through an inductive load, and more particularly to a control circuit for quickly decreasing the current flow through an inductive load.

BACKGROUND OF THE INVENTION

It is known in the art relating to control circuits to provide a control circuit to control the current through an inductive load. The current through an inductive load can be increased by providing a positive voltage across the load and the current can be decreased by providing a negative voltage across the load. In other words, an energy source must be applied to an inductive load for increasing the current and an energy sink is needed across it for reducing the current. When only a unipolar power source, such as a battery or other DC source, supplies power to an inductive load which has one end connected to the battery ground, some special means are necessary to generate the negative voltage during decreasing currents.

Most conventional circuits used to control the current through inductive loads use two switches to increase and decrease the current, however, the decrease in load current can be relatively slow. For a faster decrease in load currents, a zener diode or an external resistor has been added in series with the second switch. However, this may create additional loss even when the load current is maintained at a fixed value by pulse width modulation of the output voltage and, therefore, cannot be used for output currents greater than a few amperes.

One application for such control circuits is in a Magneto-Rheological (MR) fluid-based variable damping device developed for automotive suspension control applications. In such a device, a continuously variable damping force is achieved by varying the current through a coil that controls the magnetic field applied across the fluid passing through an annulus. Another application for the control circuit is a servo-valve which uses current through a coil to control the pressure across a valve. Other applications of MR devices include clutches for transmission, steering and fan control, engine mounts and valves. The present invention disclosed herein provides better controllability of magnetically operated devices using a coil.

SUMMARY OF THE INVENTION

The present invention is directed to a circuit for controlling current flow through an inductive load powered by a unipolar power source. The control circuit uses three electronic switches and a subcircuit to control the current flow through the load. First, second and third switches are series connected, sequentially from first to third, between positive and negative terminals of the power source. The second and third switches are connected in series between the positive and negative terminals of the load. The first switch is connected to controllably couple positive voltage therethrough, the second switch is connected to controllably or passively block positive voltage and couple negative voltage therethrough, and the third switch is connected to controllably couple negative voltage therethrough. The third switch may be configured in the subcircuit to develop a controlled negative voltage drop across the load during a discharge condition.

In accordance with one aspect of the invention, closure of the first switch and opening of the second switch results in a positive voltage across the load and increased current flow. In accordance with another aspect of the invention, opening of the first switch, closing of the second switch, and closing of the third switch disconnects the power source from the load and short circuits the inductive load resulting in substantially zero voltage across the load and relatively slow decay of the inductive current. In accordance with another aspect of the invention, rapid decay of the current may be accomplished by opening the third and first switches and closing the second switch thereby causing the decaying inductive current to flow through a subcircuit resulting in a negative voltage across the load. In accordance with another aspect of the invention, the third switch may be configured to provide a controlled voltage drop across the load to quickly decay inductive currents. This results in a circuit that controls the load current in varied and efficient manners.

These and other aspects of the invention will be more fully understood from the following description of certain specific embodiments of the invention taken together with the accompanying drawings.

BRIEF DESCRIPTION OF THE DRAWINGS

The present invention will now be described, by way of example, with reference to the accompanying drawings, in which.

DESCRIPTION OF THE PREFERRED EMBODIMENT

Conventional prior art circuits provided to control the current through inductive loads use only two switches, the first one of which may take the form of a conventionally configured high or low side driver and the second one of which may take the form of a conventionally configured anti-parallel or free-wheeling diode coupled across the inductive load. The driver is controlled conductive to couple a source voltage across the inductive load and non-conductive to de-couple the source voltage from across the inductive load. Conventional pulse width modulation of the driver may be employed to control the current through the inductive load to a commanded level and profile.

Figure 3:
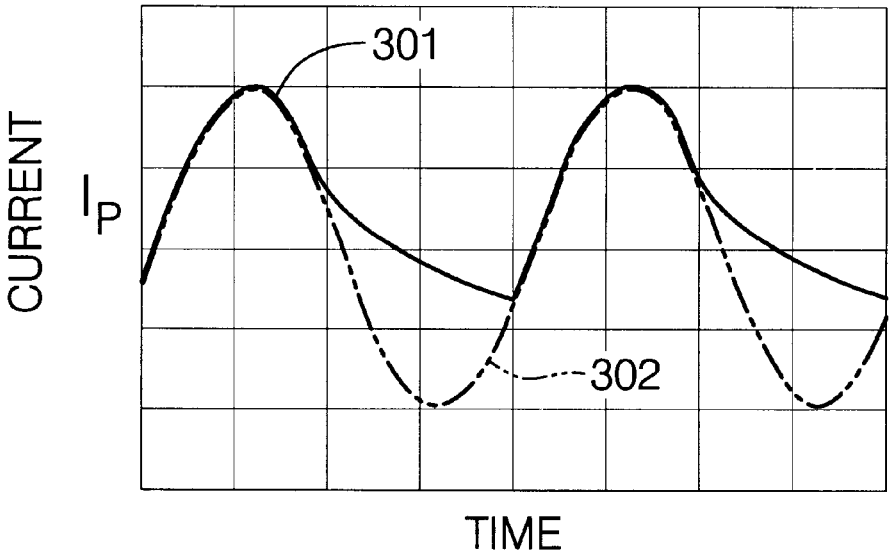
PRIOR ART FIG. 3
FIG. 3 is a graph of current vs. time through an inductive load of a conventional circuit using only two switches.

These types of circuits produce a relatively slow decrease in load current, as shown in the FIG. 3 illustration representative of load current 301 developed through an inductive load in response to a substantially sinusoidal current command 302 between zero and 20 ampere peaks of predetermined frequency. The current command is conventionally translated into a pulse width modulated signal applied to the first switch to pulse width modulate the application of the source voltage across the inductive load. For rising output currents, relatively good correspondence between commanded and actual load current may be achieved and the curves 301 and 302 essentially conform as illustrated. However, it is noted that decreasing load currents may exhibit significant divergence from the commanded currents due to the effects of the decay time constants of the inductive load. For faster decreasing load current response, a zener diode or an external resistor have been added in series with the second switch (free-wheeling diode). However, this disadvantageously creates dissipative losses when inductive currents free-wheel therethrough during periods when the inductive response characteristics are not a limiting factor in meeting the commanded current levels.

Referring now to the drawings in detail, numeral 10 generally indicates a control circuit for controlling the current through a single ended inductive load 12. The control circuit 10 generates three voltage level signals across the load 12 to achieve fast and efficient control of the load current. The control circuit 10 is intended to be used with inductive loads that have one end tied to an input power source and a unipolar load current. While it is preferred that the negative ends of the source and load be directly coupled, similar concepts can be used when the positive ends of the source and load are directly coupled.

Figure 1:
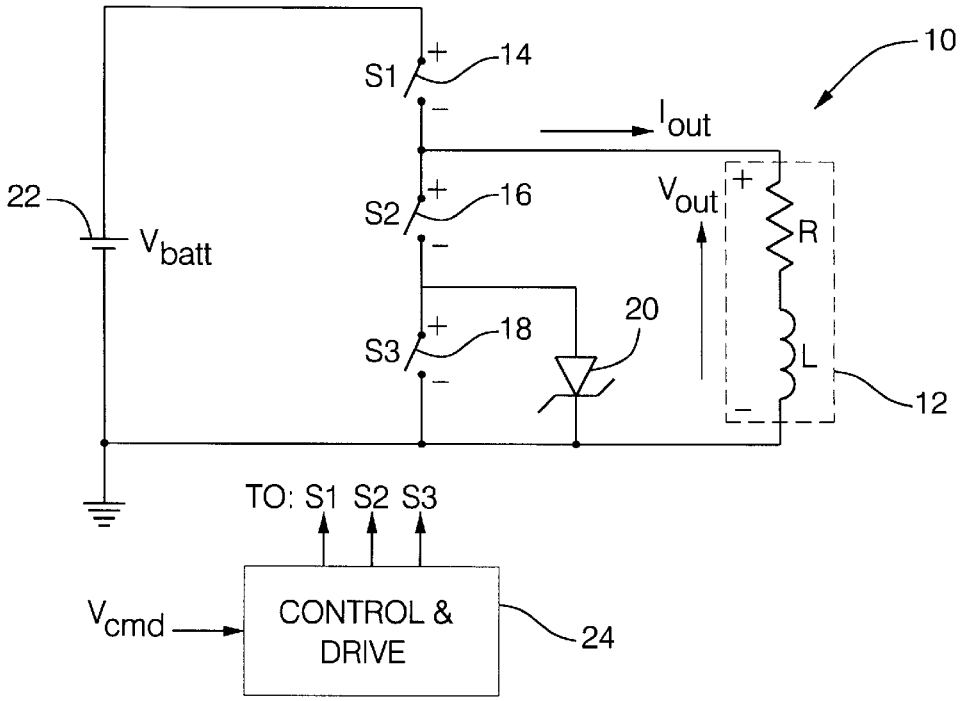
FIG. 1 is a functional diagram in accordance with the present invention having a zener diode.
Figure 2:
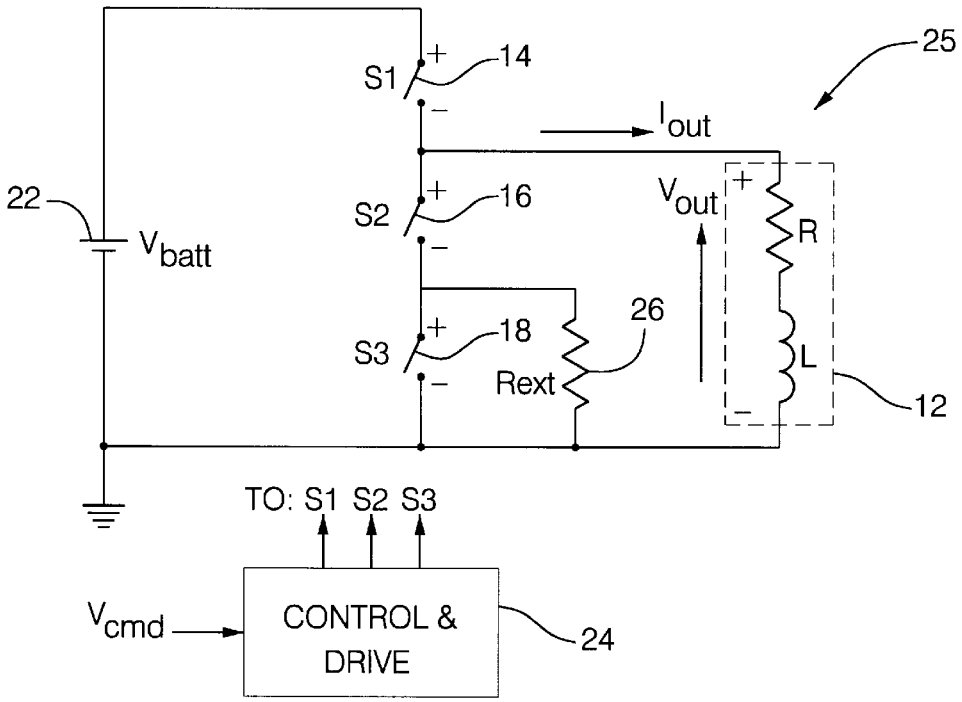
FIG. 2 is an alternative functional diagram in accordance with the present invention having an external resistor.

Referring to FIG. 1, the control circuit 10 includes first, second and third electronic switches 14, 16, 18, a subcircuit, a power source ($V_{batt}$) 22, drive circuitry 24 for controlling the switches 14, 16, 18, and an inductive load 12. The subcircuit includes a zener diode 20 and the second and third switches 16, 18. FIG. 2 illustrates a control circuit 25 similar to that of FIG. 1 but the zener diode 20 has been replaced by an external resistor ($R_{ext}$) 26. In both circuits, the first, second and third switches 14, 16, 18 can be metal-oxide semiconductor field-effect transistors (MOSFET), insulated gate bipolar transistors (IGBT), bipolar junction transistors (BJT) or any controllable switch with fast switching capability. The first, second and third switches 14, 16, 18 are connected in sequential series between positive and negative terminals of the power supply 22. The second and third switches 16, 18 are connected in series between positive and negative terminals of the inductive load 12. The switch 14 is connected to provide positive voltage blocking capability when in the open or non-conductive state, while the third switch 18 is connected to provide negative voltage blocking capability in the open or non-conductive state. The second switch 16 may be passive as with a diode configured in the circuit with the cathode coupled to the negative side of the first switch 14 and the anode connected to the positive side of third switch 18. Alternatively, switch 16 may be a controlled switch with controllable conductive and non-conductive states. With either passive or controlled configurations, the switch 16 is connected to provide positive voltage blocking capability and negative voltage conductivity.

The switches 14, 18 are turned ON and OFF in accordance with a command signal $V_{cmd}$ via the control and drive means 24. Various combinations of conduction states of the switches 14, 16, 18 allows three different voltage levels—to wit positive, zero, and negative—to be produced across the inductive load 12. When the first switch 14 is conductive and the second switch 16 is non-conductive, the third switch 18 may be commanded conductive or non-conductive, and the output voltage $V_{out}$ across the inductive load 12 equals the power source voltage and the output current $I_{out}$ increases at an initial rate given by $(V_{batt}-I_{out}R)/L$. When the voltage drop across the load resistance (R) is negligible compared with $V_{batt}$, the rate of increase of output current $I_{out}$ is $V_{batt}/L$. In order to achieve a zero output voltage, the first switch 14 is controlled non-conductive, the third switch is controlled conductive, and the second switch 16 is passively or controlled conductive. This provides a recirculatory current path for the current flowing through the inductive element. With zero volts across the load 12, the current will decrease exponentially with a time constant of L/R. However, when the first switch 14 is controlled non-conductive, the second switch 16 is conductive and the third switch 18 is controlled non-conductive, the load current will circulate through the zener diode 20 of FIG. 1 or the external resistor 26 of FIG. 2. Because the load current flows through the zener diode 20 or the resistor 26, a negative voltage equal to the voltage drop across the zener diode ($V_z$) or across the resistor ($V_r$) is developed across the inductive load 12. If the load resistance is negligibly small, the initial decrease rate of the load current is the zener diode voltage over the inductance ($V_z/L$) for the circuit in FIG. 1. The time constant for the circuit in FIG. 2 is the load inductance L over the sum of the load resistance R and the external resistance $R_{ext}$, or $(L/(R+R_{ext}))$. Thus, a faster decay of the load current is possible at a rate programmable by the inclusion of the zener diode 20 or by the external resistor 26 across the inductive load 12.

The command signal $V_{cmd}$ dictates the control of the switches and consequently the one of the three voltage levels across the inductive load. The control and drive means 24 provides appropriate signals to control the conductive states of the switches, including switch S2 in configurations wherein switch S2 is not a passive device. $V_{cmd}$ may represent an analog control signal or a digital control signal. Similarly, control and drive means 24 may provide signals to control the switches by way of analog, digital, microcomputer, or alternative control. Some general relationships among the various switch states are as follows. When switch S1 is conductive, switch S2 is non-conductive and vice-versa. When switch S2 is conductive, switch S3 may be conductive or non-conductive in accordance with the desired load voltage of zero or negative, respectively.

Figure 4:
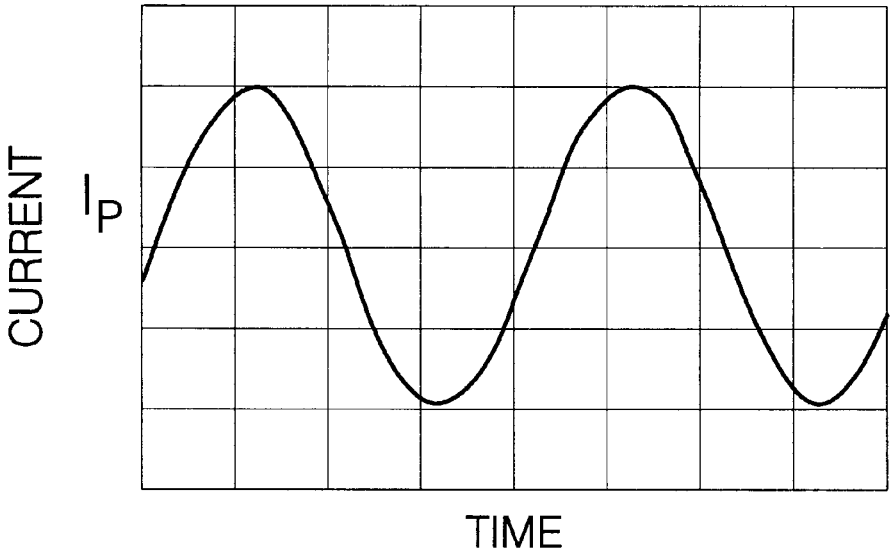
FIG. 4 is a graph of current vs. time through an inductive load of a preferred embodiment of the present invention.

The addition of a third switch in the configurations of the present invention allow the output voltage to be controlled to one of the power source voltage and zero for increasing or maintained currents, and to one of a negative voltage (e.g. the reverse biased voltage across the zener diode ($-V_z$) or the voltage across the external resistor ($-V_r$) and zero for decreasing currents. Output current controlled in accord with the present invention will more closely resemble the trace illustrated in FIG. 4 in response to the same current command as previously described with respect to FIG. 3. By using three voltage levels to control the current through the inductive load as described, control of the load current is responsive, accurate, and highly efficient, as will become more apparent in connection with the descriptions which follow.

Figure 5:
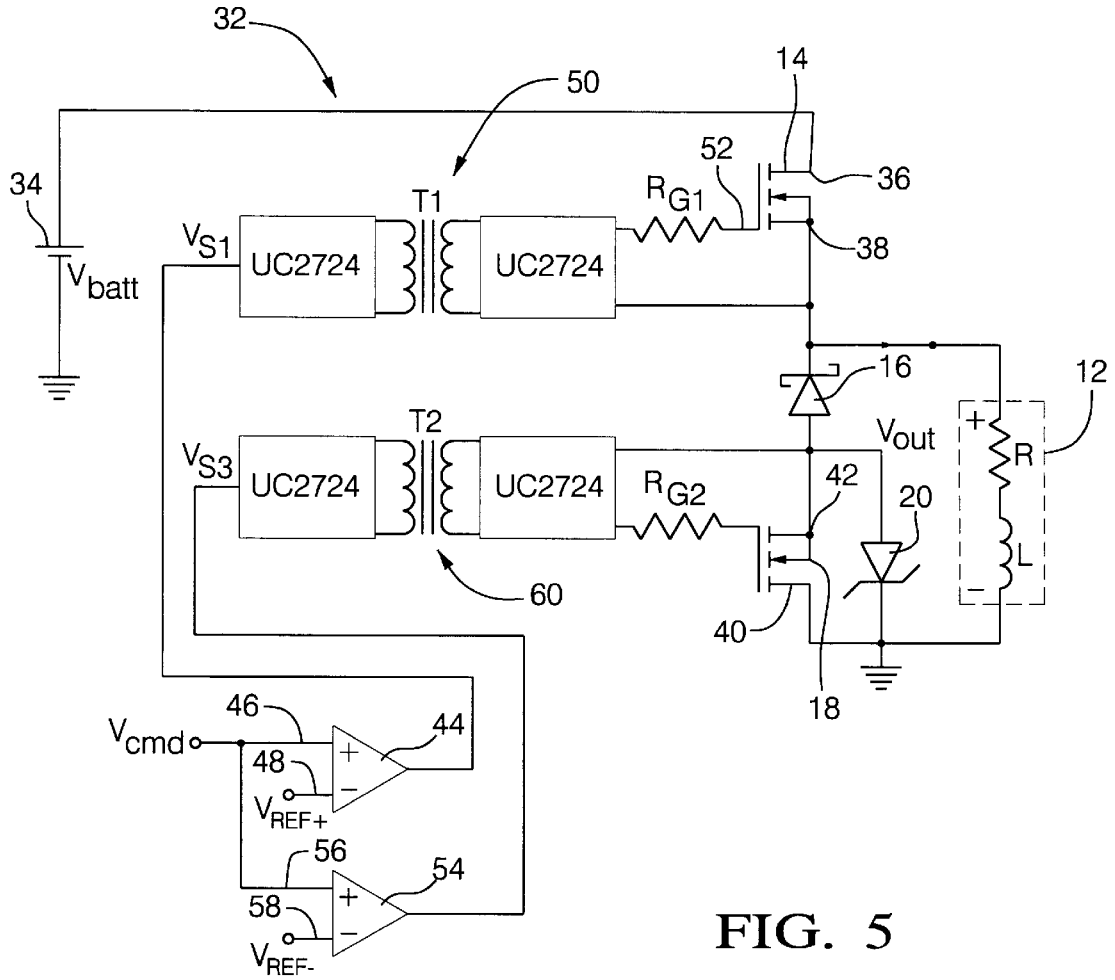
FIG. 5 is a schematic diagram of one embodiment of the invention.

FIG. 5 shows a control circuit 32 illustrating a preferred embodiment of the invention. The control circuit 32 includes three switches 14, 16, 18 configured as previously described. The first and third switches 14, 18 are MOSFET switches. The second switch 16 is a schottky diode. The positive side of a 12 volt battery 34 is connected to the drain 36 of the first switch 14. The source 38 of the first switch 14 is connected to cathode side of the diode 16. The anode side of the diode 16 is connected to source 42 of the third switch 18. The drain 40 of the third switch 18 is connected to a common ground. A zener diode 20 is connected in parallel with the third switch 18; anode to source, cathode to drain. The breakdown voltage for the zener diode is chosen to be substantially 10 volts. For the specific implementation, the load resistor R equals 0.25 ohms, the inductor L equals 3.6 mH and the load current equals 20 amperes.

The voltage across the inductive load 12 is controlled in accordance with a command signal $V_{cmd}$. The command signal $V_{cmd}$ and a predetermined positive voltage reference signal $V_{ref+}$ are applied to a first comparator 44 via signal lines 46, 48, respectively. An output signal $V_{S1}$ of the first comparator 44 is applied to a gate drive circuit 50. The output signal of the gate drive circuit 50 is applied to the gate 52 of the first switch 14. The gate drive circuit 50 isolates and steps up the voltage from the first comparator 44 in order to drive the first switch 14 between ON/OFF states. The output signal $V_{S1}$ of the first comparator 44 will be logically HIGH when the command signal $V_{cmd}$ is higher than the reference signal $V_{ref+}$. The command signal $V_{cmd}$ and a predetermined negative voltage reference signal $V_{ref-}$ are applied to a second comparator 54 via signal lines 56, 58, respectively. An output signal $V_{S3}$ of the second comparator 54 is applied to a gate drive circuit 60 which is connected to the gate 62 of the third switch 18 to drive the switch 18 between ON/OFF states. The gate drive circuit 60 isolates and steps up the voltage from the second comparator 54 in order to drive the third switch 18. The output signal $V_{S3}$ of the second comparator 54 will be logically LOW when the command signal $V_{cmd}$ is less than the reference signal $V_{ref-}$.

When command signal $V_{cmd}$ is greater than the reference signal $V_{vef+}$, the output signal $V_{S1}$ of the first comparator 44 is logically HIGH and the output signal $V_{S3}$ of the second comparator 54 is logically HIGH. In this instance, the first switch 14 is conductive, and the third switch is commanded conductive. However, diode 16 is reverse biased thereby preventing any current flow therethrough. Hence, a positive voltage is across the inductive load 12 the current flows therethrough. When the command signal $V_{cmd}$ is in between the reference signal $V_{ref+}$ and the reference signal $V_{ref-}$, the output signal $V_{S1}$ of the first comparator 44 is logically LOW and the output signal $V_{S3}$ of the second comparator 54 is logically HIGH. In this instance, the first switch 14 is non-conductive and the third switch 18 is commanded conductive. Diode 16 is forward biased and the inductive load current circulates through the third and second switches and, therefore, the voltage across the inductive load 12 is substantially zero. When the command signal $V_{cmd}$ is less than the reference signal $V_{ref-}$, the first switch 14 is non-conductive and the third switch 18 is non-conductive. In this instance, the load current will circulate through the zener diode 20 (when the breakdown voltage threshold is reached) and the second switch 16, resulting in the voltage across the load 12 being substantially equal to the voltage across the zener diode 20, thereby causing accelerated decay of the load current until the command signal $V_{cmd}$ is changed or the load current reaches zero. Thus, the current through the inductive load 12 is effectively controlled in accordance with the conductive states of the three switches 14, 16, 18 and the zener diode 20 which in various controlled combinations provide three voltage levels across the load in response to specific command signals.

Figure 6:
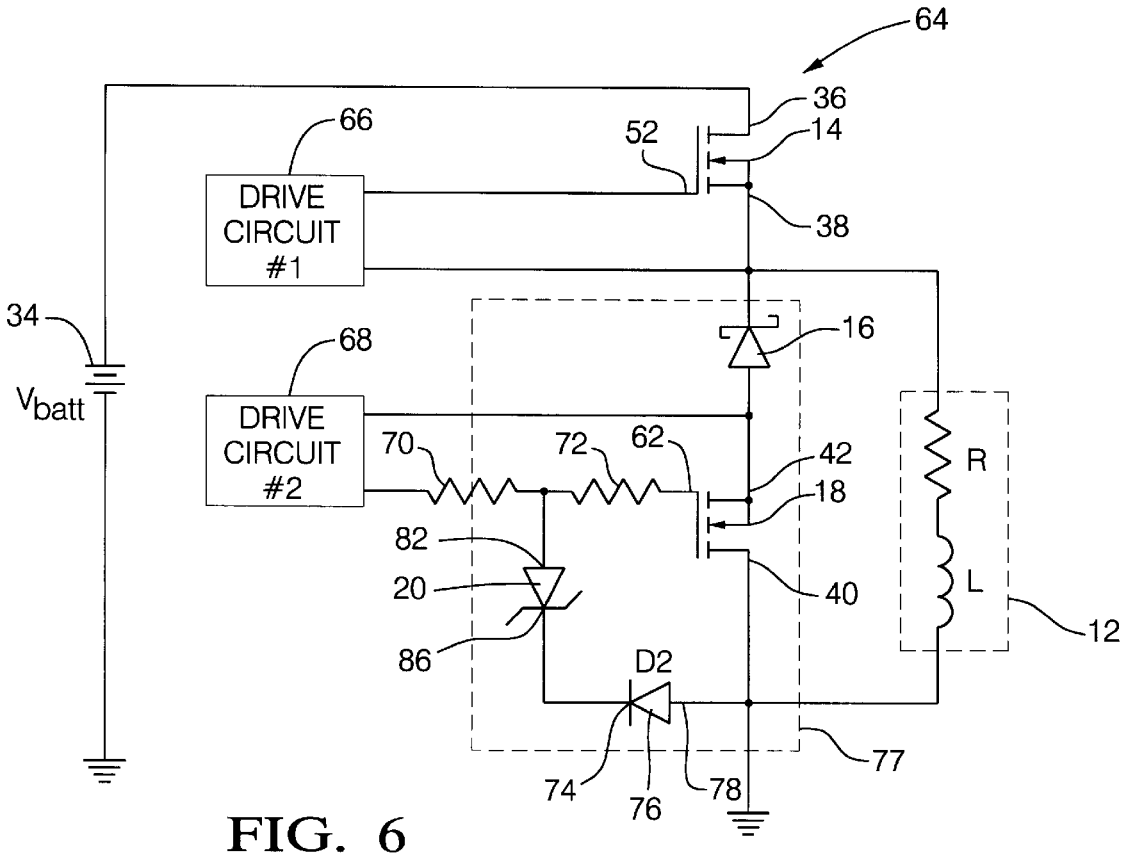
FIG. 6 is a schematic diagram of another embodiment of the invention.

A second embodiment of the present invention is illustrated by a control circuit 64 in FIG. 6. The control circuit 64 has three electronic switches similarly connected as the switches of the preferred embodiment illustrated in FIG. 5. The first and the third electronic switches 14, 18 are MOSFET transistors. The second switch 16 is a schottky diode. The first and third switches 14, 18 are driven by first and second drive circuits 66, 68, respectively. Drive circuits 66, 68 provide gate control signals to first and third switches 14, 18 in a manner similar to gate drive circuits 50, 60 in accordance with a command signal (not separately illustrated) as described with respect to the embodiment of FIG. 5. In the description of the embodiments illustrated with respect to FIGS. 6 and 7, commanding the third switch (MOSFET) conductive is understood to mean driving the MOSFET into a saturated, substantially zero source-to-drain voltage, condition (i.e. shorted across drain and source); and, commanding the third switch (MOSFET) non-conductive is understood to mean providing a drive signal from the drive circuit which does not have the effect of driving the MOSFET into a saturated, substantially zero source-to-drain voltage. As will become apparent from the following description, additional circuit elements may effectuate a biasing of the MOSFET into a controlled conductive state, however, not into a saturated conductive state. Resistors 70 and 72 isolate the drive circuit 68 from the gate 62 of the third switch 18 when it is commanded non-conductive. The zener diode 20 is connected at its anode to the gate 62 of the third switch 18 and at its cathode to the cathode 74 of the diode 76. The anode 78 of the diode 76 is connected to the drain 40 of the third switch 18. This configuration allows the third switch 18 to conduct with a negative source-to-drain voltage substantially equal to $-(V_z+V_{th}+V_d)$; where $V_{th}$ is the source-to-gate threshold voltage, $V_d$ is the voltage drop across forward biased diode 76, and $V_Z$ is the breakdown voltage of zener diode 20. The inductive current is decreased by directing the current through subcircuit 77 which includes the second switch 16, third switch 18, the diode 76 and the zener diode 20. When the third switch 18 is commanded non-conductive it functions as a programmable zener diode with a breakdown voltage—the drain-to-source voltage—substantially equal to $V_z+V_{th}+V_d$. The MOSFET carries a vast majority of the inductive current at the drain-to-source voltage; thus, zener diode 20 can be a low power device because it does not carry significant current.

Figure 7:
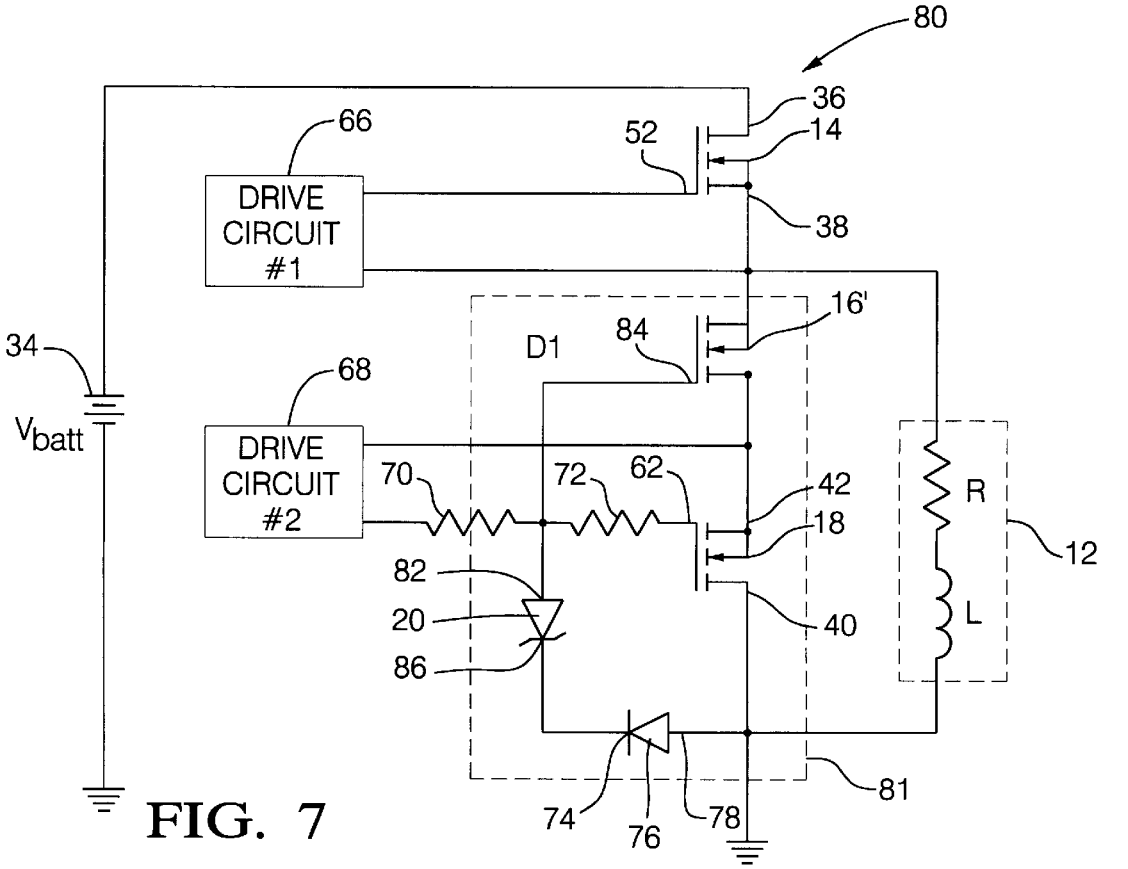
FIG. 7 is a schematic diagram of another embodiment of the invention.
Figure 8A:
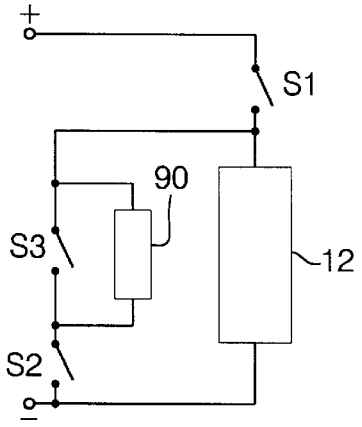
FIGS. 8A–8D are functional diagrams of alternative arrangements for circuit elements in accordance with the invention; and, FIG. 9 is a functional diagram of another embodiment of the invention.
Figure 8B:
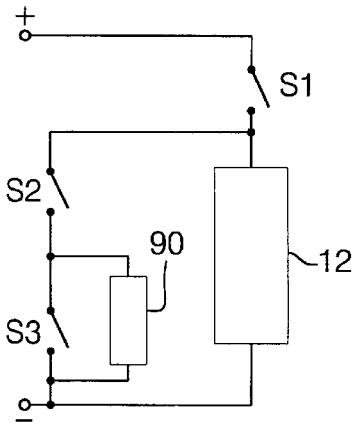
Figure 8C:
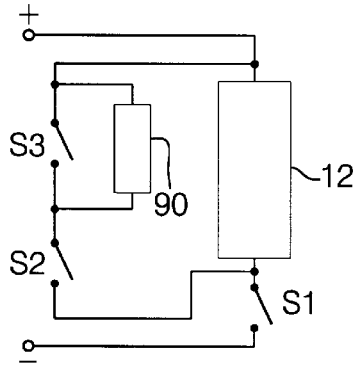
Figure 8D:
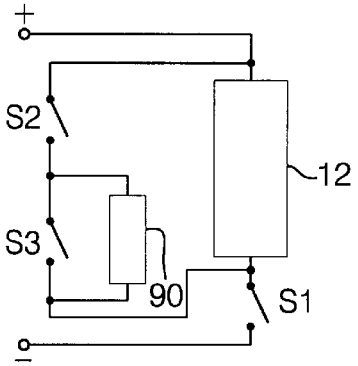

A third embodiment is illustrated by a control circuit 80 in FIG. 7. All three electronic switches 14, 16, 18 are MOSFET transistors. Using a MOSFET transistor in place of a schottky diode for the second switch can significantly improve efficiency because the voltage drop across a MOSFET transistor in the conductive state is much smaller than that across a forward biased diode. The first switch 14 is driven by the first drive circuit 66 and the second and third switches 16', 18 are driven by the second drive circuit 68. Resistors 70 and 72 isolate the drive circuit 68 from the gate 62 of the third switch 18 when it is commanded non-conductive. The anode 82 of the zener diode 20 is coupled to the gate 84 of the second switch 16 and to the gate 62 of the third switch 18. The cathode 86 of the zener diode 20 is connected to the cathode 70 of the diode 76, and the anode 78 of the diode 76 is connected to the drain 40 of the third switch 18. This configuration allows the third switch 18 to conduct with a negative source-to-drain voltage substantially equal to $-(V_z+V_{th}+V_d)$. The inductive current is decreased by directing the inductive current through a subcircuit 81 which includes the second and third switches 16', 18, the zener diode 20, and the forward biased diode 76. When the third switch is commanded non-conductive it acts as a programmable zener diode with a breakdown voltage substantially equal to $V_z+V_{th}+V_d$. The MOSFET carries a vast majority of the inductive current at the drain-to-source voltage; thus, zener diode 20 can be a low power device because it does not carry significant current.

FIGS. 8A through 8D illustrate alternative general arrangements for circuit elements in accord with the present invention. In all of the FIGS. 8A through 8D, the switches labeled S1 through S3 correspond in function to the similarly labeled switches illustrated in the previous figures and previously described. Similarly, the inductive element labeled 12 in the present FIGS. 8A through 8D corresponds to such element as previously disclosed herein. The circuit element labeled 90 represents a circuit element, such as for example a zener diode or resistor, as previously described to effectuate a negative voltage across the inductive load terminals.

Figure 9:
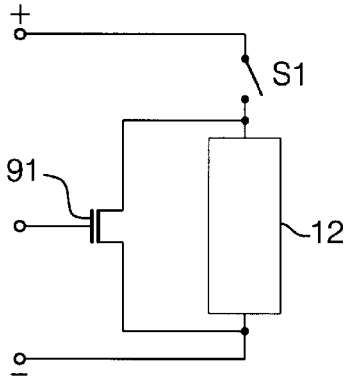

FIG. 9 illustrates an additional embodiment of the invention wherein a field effect transistor 91 is coupled across the terminals of the inductive element 12. A variable gate voltage, $V_g$, is used to control the drain to source resistance of the field effect transistor from a substantially open condition through a substantially closed condition. Control of the effective resistance of a field effect transistor in such a manner is generally well known. Such an arrangement advantageously displaces the need for a plurality of switches and voltage drop producing elements such as break down diodes or resistors and is almost infinitely variable in the effective resistance which may be controlled by application of the variable gate voltage.

While the invention has been described by reference to certain illustrative embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A control circuit for controlling current flow through an inductive load powered by a unipolar power source, comprising:

first, second and third electronic switches connected in sequential series between positive and negative terminals of said power source and said second and third switches connected in series between positive and negative terminals of said load;

the first switch being connected to allow or block positive voltage therethrough, the second switch being connected to block positive voltage and allow negative voltage therethrough, and the third switch connected to allow or block negative therethrough;

said third switch being connected in a subcircuit to develop a negative voltage drop across the load during a discharge condition; and a drive circuit for closing of the said first switch to connect positive voltage from the power source across the load causing an increasing load current, opening of the first switch and closing the third switch to disconnect the power source from the load and short circuit the inductive current, and opening of the third and first switches to direct decaying inductive current through the subcircuit causing a negative voltage across the load, the subcircuit and the third switch together providing a path for current flow resulting in rapid decay of the inductive current;

wherein said subcircuit includes a zener diode and a diode connected in series between a gate and a drain of the third switch whereby upon opening of the first and third switches, said third switch is closed by the negative voltage across the subcircuit of the zener diode and the diode and said subcircuit provides a path for rapid decay of the inductive current flow.

2. The control circuit of claim 1 wherein the second switch is a schottky diode.

3. The control circuit of claim 1 wherein the second switch is a MOSFET transistor connected with said subcircuit.

* * * * *